United States Patent [19]

Pimlott

[11] Patent Number: 4,713,162

[45] Date of Patent: Dec. 15, 1987

[54] BIPOLAR ELECTROLYTIC CELL

[75] Inventor: John R. Pimlott, Sweeny, Tex.

[73] Assignee: The Dow Chemical Company, Midland, Mich.

[21] Appl. No.: 901,845

[22] Filed: Aug. 29, 1986

[51] Int. Cl.[4] ..... C25C 3/08

[52] U.S. Cl. ..... 204/254; 204/255; 204/256

[58] Field of Search ..... 204/254, 255, 256; 219/137 R

[56] References Cited

U.S. PATENT DOCUMENTS

| | | | |
|---|---|---|---|
| 4,116,805 | 9/1978 | Ichisaka et al. | 204/254 |
| 4,382,172 | 5/1983 | Takasugi et al. | 219/85 CM |
| 4,389,289 | 6/1983 | De Nora | 204/255 |

*Primary Examiner*—R. L. Andrews
*Attorney, Agent, or Firm*—Jay C. Taylor

[57] ABSTRACT

A bipolar electrolytic cell comprises a plurality of side-by-side cell units, each unit having parallel anode and cathode plates spaced by a centerboard and electrically connected by a bipolar connection comprising a plurality of copper rods extending through the centerboard and shielded at their opposite ends from electrolyte in the cell by protective covers projection welded to opposite sides of the centerboard. The cover for one end of each rod comprises a cup having the base of its opening shaped to conform closely to the one end and frictionally welded thereto.

A plurality of similar spacer and ring assemblies are arranged over opposite sides of the centerboard. Each assembly comprises a spacer projection welded to an associated side of the centerboard and to the inner periphery of a ring extending around the spacer. The spacers at one side of the centerboard may comprise the protective covers at said one side. The outer peripheries of the rings of adjacent assemblies are projection welded to opposite ends of plate supporting units having plate supporting edges projection welded to the anode or cathode plate confronting said associated side. The rings and ribs are located at preselected adjusted positions with respect to the spacers, such that the plates welded to the ribs are supported in predetermined planes assuring the desired minimum parallel spacing between the anode and cathode plates of adjacent cell units.

20 Claims, 12 Drawing Figures

BIPOLAR ELECTROLYTIC CELL

The present invention relates to improvements in a bipolar electrolytic cell and method of manufacture.

BACKGROUND AND OBJECTS OF THE INVENTION

A typical bipolar electrolytic cell comprises an outer frame or housing, such as a dielectric plastic, enclosing and supporting a number of bipolar units arranged in series. Each unit comprises parallel anode and cathode plates spaced by a partition or centerboard. In each unit, the centerboard may comprise a form sustaining steel plate confronting and spaced from the cathode plate, and a titanium sheet bonded to the steel plate and confronting and spaced from the anode plate. A low resistance electrical connection between the anode and cathode plates of the unit may include a plurality of copper rods extending through the partition or centerboard and having their opposite ends protected from electrolyte in the cell by means of anode and cathode protective covers electrically connected with the associated ends of the copper rods.

In one conventional cell known as a deNora cell, each copper rod extends in screw threaded relationship through the centerboard. One outer end of the threaded rod projects from the anode surface of the centerboard, i.e. the titanium sheet, and screws into an internally threaded tubular titanium sleeve. An inner end of the sleeve is welded to the titanium sheet to effect a seal entirely around the copper rod. The interior of an outer end portion of the titanium sleeve is welded and bonded electrically to the copper rod by means of a silver filler or suitable alloy for effecting a welded electrical connection between the titanium sleeve and copper rod. The protective anode cover is completed by means of a titanium disc welded to the outer end of the titanium sleeve to close the same and shield the welded bond between the sleeve and rod from electrolyte within the cell.

Similarly, an internally threaded tubular steel sleeve is screwed onto a threaded end of the copper rod that projects from the cathode surface or steel plate of the centerboard. An inner end of the steel sleeve is welded to the steel plate to effect a seal entirely around the copper rod. The interior of an outer end portion of the steel sleeve is welded and bonded to the copper rod by means of a silver filler or suitable electrically conducting alloy, such as mentioned above, and a steel disc is welded to the outer end of the steel sleeve to close the same and complete the protective anode cover for shielding the welded bond between the steel sleeve and copper rod from electrolyte within the cell.

A comparatively large number of the low resistance connections between the parallel anode and cathode plates are required (74 in a typical cell) because the connections also serve to support the plates precisely in parallelism with each other. In consequence, the conventional construction requires a large number of difficult, costly, and time consuming manual welding operations. Furthermore, the electrical connection between the titanium sleeve and copper rod depends in part upon the screw-threaded connection. During operation of the cell, a titanium oxide film gradually develops at the region of the threaded connection, increasing the electrical resistance between the sleeve and rod and gradually impairing the efficiency of the cell which desirably operates at a low potential difference and high current flow between the parallel plates of adjacent units, as for example in the neighborhood of 3 volts and 2 ampers per square inch.

Important objects of the present invention are to provide improvements in bipolar cells of the general type described wherein reliance upon a threaded engagement between a titanium sleeve and copper rod for an electrical connection is avoided, and to provide improvements in the process of manufacturing such a cell whereby the heretofore laborious manual welding between each copper rod and associated anode protective cover is replaced by high speed automated welding procedures that provide a non-corrosive direct surface-to-surface weld between the rod and cover, thereby to materially reduce the time and cost of manufacturing the cell and also to increase its useful operating life by eliminating the heretofore screw threaded electrical connection between each copper rod and associated protective titanium cover.

Other objects are to provide improved means for supporting the anode and cathode plates parallel to each other and for avoiding localized pressure on these plates at the regions of support.

The foregoing objects are accomplished by providing a partition or centerboard having a number of holes spaced over its surface and extending therethrough for a corresponding number of copper rods as required for the electrical connections. At the cathode side of the centerboard, a separate steel sleeve is associated with the cathode end of each copper rod and is provided at one end with a coaxial endwise tapering annular welding projection adapted to seat against the centerboard steel plate entirely around the associated hole through which the copper rod extends. The centerboard is then assembled with the steel sleeves aligned coaxially with their respective holes and with the annular welding projections pressing against the steel plate around the holes. The assembled steel sleeves and steel plate are then welded together under pressure by conventional projection welding procedures. By reason of the annular tapered welding projection of each sleeve, the electrical resistance and consequent heat of the welding operation is concentrated at the tapered extremity of each welding projection to effect a positive weld between the steel plate and each sleeve entirely around the associated centerboard hole.

Each copper rod is dimensioned to pass freely through its associated centerboard hole and coaxially into the associated steel sleeve that is welded to the steel plate at the cathode side. A separate cup shaped or thimble type titanium button is provided with an opening at one end dimensioned to receive the anode end of each copper rod freely. The interior base of the opening is shaped to conform closely to the latter end, which is seated under pressure against the conforming interior base of the opening. The rod and button are then frictionally welded together by conventional friction welding procedure, as for example by relative spinning of the parts while being pressed together, to effect a non-oxidizable electrical connection therebetween. The surface area of the frictionally welded parts is sufficient to achieve the desired low resistance electrical connection therebetween that is not subject to deterioration by oxidation. No additional electrical connection is required, such as a silver or alloy filler used heretofore.

Each titanium button is also provided around the mouth of its opening with an annular endwise tapering welding projection arranged to seat against the titanium sheet entirely around the associated centerboard hole through which the copper rod projects. The centerboard and welded together titanium buttons and copper rods are assembled with the rods passing through their respective centerboard holes and coaxially into the steel sleeves welded to the cathode side of the centerboard, and with the annular welding projections of the titanium buttons pressed against the titanium sheet around their respective centerboard holes. The latter are sufficiently oversize with respect to the copper rods to enable their radial adjustment in the holes to accommodate production deviations from coaxial alignment of the steel sleeves and titanium buttons.

The titanium buttons are projection welded to the titanium sheet by conventional projection welding procedures. The tapered annular welding projections provide the high electrical resistance at the annular region of contact with the titanium sheet to effect a positive weld thereto and seals entirely around the associated copper rods.

In accordance with conventional practice, the interior of each steel sleeve is welded to the cathode end of the associated copper rod by means of a silver filler or suitable welding alloy, including but not limited to aluminum bronze, silicon bronze, nickel and nickel based alloys. The outer end of the steel sleeve remote from the partition wall is then closed by welding a steel cap thereto by conventional procedures, as for example by metal inert gas (MIG) welding, thereby to provide in cooperation with the titanium button at the anode side of the partition wall a complete closure for the copper rod and a low resistance electrical connection from the steel sleeve to the titanium button via the copper rod.

The electrical connection between the parallel anode and cathode plates is preferably completed by electrically connecting only one of the protective covers for each copper rod directly to one of the latter plates. Thus, if the anode cover is connected directly to the anode plate, the cathode cover at the opposite end of the copper rod will not be connected directly to the cathode plate, and vice versa. By way of example in a preferred construction, titanium ribs extend between and are connected in adjusted positions by welding, as described herein, to adjacent titanium anode protective covers. An outer edge of each rib extends in parallelism with the anode plate and is also welded thereto, such that the ribs complete a direct electrical connection between the anode covers and the anode plate, rigidify the cell structure, and maintain the anode plate in a predetermined plane.

Spaced over the surface of the partition or centerboard and also radially from the copper rods that extend through the centerboard are a plurality of steel spacer buttons or members welded in the preferred construction to the steel centerboard plate. Similarly to the titanium ribs, steel ribs extend between and are welded in adjusted positions to adjacent steel spacer buttons. The edges of the steel ribs adjacent to the cathode plate define a surface in parallelism with the anode plate and are welded to the cathode plate to complete an electrical connection between the cathode plate and steel centerboard plate and through the latter to the steel protective covers and copper rods. Likewise, the steel ribs cooperate with the titanium ribs to rigidify the cell structure and maintain the cathode and anode plates of adjacent bipolar units in closely spaced parallelism with each other. By virtue of the steel spacer members or buttons spaced radially from the titanium anode covers, the supports for the anode and cathode plates are not aligned with each other and localized pressure on these plates is avoided, as would otherwise result from a stack-up of dimensional tolerances or thermally induced dimensional changes.

Also in a preferred construction, similarly to the welding projections provided on the protective covers for the ends of the copper rods, prior to welding the steel spacer buttons to the steel centerboard plate, a face of each such button is provided with an annular endwise tapering welding projection to facilitate welding of the spacer buttons to the steel centerboard plate by conventional projection welding procedures.

According to a further improvement described in detail herein, titanium rings are welded at their inner peripheries in adjusted positions around each titanium button. Similarly steel rings are welded at their inner peripheries in adjusted positions around each steel spacer button or member. The titanium ribs extend between the outer peripheries of adjacent titanium rings and are welded thereto. Likewise, the steel ribs extend between and are welded to the outer peripheries of adjacent steel rings that extend around the steel spacer members. The ends of the steel ribs welded to the steel rings and the ends of the titanium ribs welded to the titanium rings are tapered endwise to facilitate welding of these ribs to their respective rings by conventional projection welding. Costly and laborious titanium inert gas (TIG) or metal inert gas (MIG) welding that have been conventional heretofore are thus avoided.

Furthermore, by virtue of the titanium and steel ribs welded to their respective rings, these elements may be suitably supported in welding jigs and adjusted prior to the welding operations until the outer edges of the ribs that are or will be subsequently welded to the anode and cathode plates define predetermined planes. The inner peripheries of the rings are sufficiently oversize with respect to the parts to which they are welded such that prior to the welding they may be adjusted axially and radially with respect to the latter parts to accommodate production tolerances in the welding of the ribs to the outer peripheries of the rings and to assure both the proper spacing between the anode and cathode plates as well as their parallelism in the completed electrolyte cell.

Other objects of this inventions will appear in the following description and appended claims, reference being had to the accompanying drawings forming a part of this specification wherein like reference characters designate corresponding parts in the several views.

THE PRIOR ART

The following U.S. patents show the state of the art:

U.S. Pat. No. 4,116,805—Ichisaka et al

U.S. Pat. No. 4,382,172—Takasugi et al

U.S. Pat. No. 4,389,289—deNora.

The above deNora patent shows steel and titanium ribs spaced so as not to exert excess localized pressure on the anode and cathode plates, but does not show the novel concept of such ribs in combination with the rings, spacer buttons, and protective covers to which they are connected by welding as disclosed in the following specification whereby adjustment of the ribs to achieve the desired parallel supporting surfaces for the cathode and anode plates is facilitated.

Friction and projection welding per se are referred to by Ichisaka et al, col. 2, lines 28–30 and col. 4, lines 39–43, and are disclosed by Takasuki et al, FIG. 2. However, these patents do not suggest the cooperable structural parts and their arrangement in a bipolar cell as disclosed for the first time herein to render such welding procedures feasible for the economical manufacture of the bipolar cell.

BRIEF DESCRIPTION OF THE DRAWINGS

FIGS. 2–9 are views similar to FIG. 1, wherein:

FIGS. 2 and 3 illustrate the progressive steps of spin-welding the copper rod and titanium button together and of thereafter projection welding the titanium button to the titanium liner of the centerboard.

FIGS. 4 and 5 illustrate the progressive stages in the projection welding of the steel anode button to the steel plate of the centerboard.

FIGS. 6 and 7 illustrate the progressive stages in the assembly and welding of the protective covers for the copper rod.

FIGS. 8 and 9 illustrate the progressive stages in the projection welding of the steel spacer buttons to the steel plate of the centerboard.

It is to be understood that the invention is not limited in its application to the details of construction and arrangement of parts illustrtated in the accompanying drawings, since the invention is capable of other embodiments and of being practiced or carried out in various ways. Also it is to be understood that the phraseology or terminology employed herein is for the purpose of description and not of limitation.

BRIEF DESCRIPTION OF THE INVENTION

Figure 1:
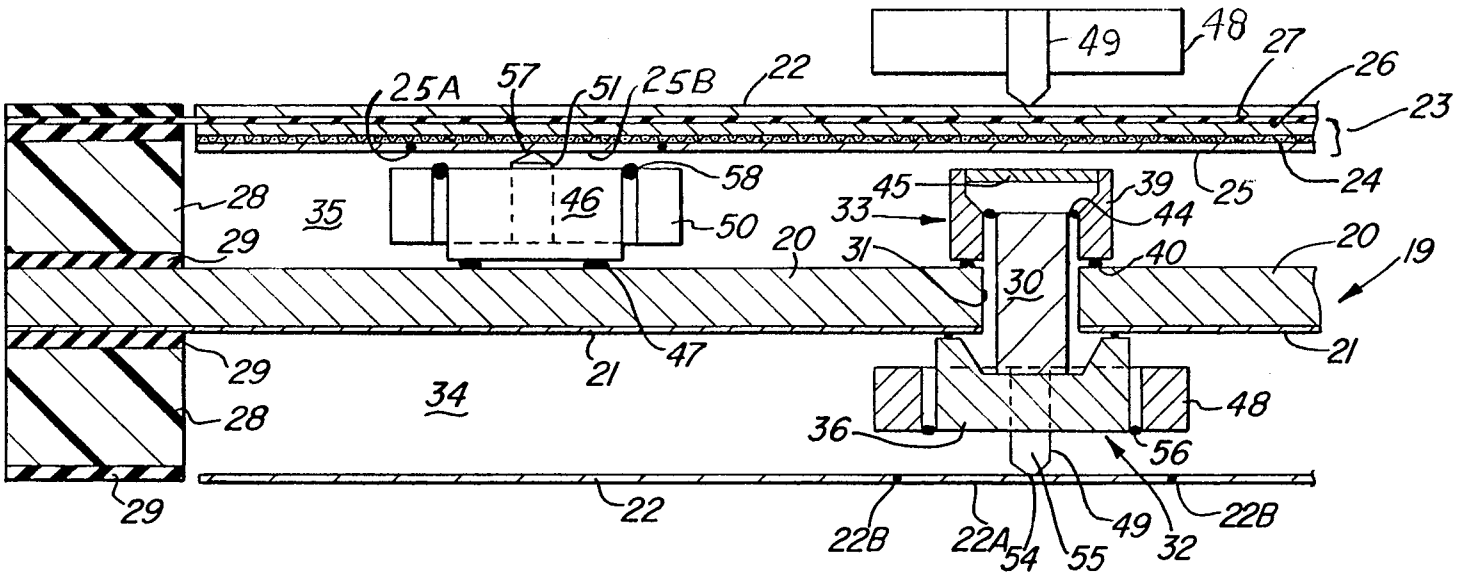
FIG. 1 is a fragmentary schematic cross sectional view through a bipolar electrolytic cell embodying the present invention.

Referring to the drawings and in particular to FIG. 1, the bipolar electrolytic cell illustrated is conventional in concept and operation and comprises an ion exchange membrane separating an anode from a cathode. Cells of the type illustrated are particularly though not exclusively useful for the electrolysis of alkali halides, such as a sodium chloride anolyte to produce chlorine gas within an anodic chamber and hydrogen gas and sodium hydroxide in a cathodic chamber.

In FIG. 1, a partition or centerboard 19, comprising a steel form-sustaining plate 20 preferably bonded to a titanium liner 21, spaces electrically connected anode and cathode plates 22 and 23 respectively to provide a bipolar unit. A battery of such units are arranged in series within the cell. Although titanium and steel are commonly preferred for use as the anodic and cathodic structures described herein, other metals and alloys known to the art for such use may be substituted. By way of example, such metals as tantalum, tungsten, columbium, zirconium, molybdenum and alloys thereof, as well as titanium alloys, may be used for the anodic structures. Likewise iron, nickel, lead, molybdenum, cobalt, and alloys thereof including major amounts of these metals alloyed in stainless steel may be used for the cathodic structures.

The anode plate 22 may comprise a foraminous titanium plate, such as a knitted or woven titanium wire mesh or bunched or expanded titanium sheet coated as is conventional with a catalyst to reduce chlorine overvoltage. The cathode plate 23 may comprise multiple layers including a resiliant foraminous spring sheet 24, such as a knitted mesh of steel wire, an inner foraminous steel current collector 25, and an outer foraminous steel cathode layer 26, which is also conventionally coated with a catalyst to reduce hydrogen overvoltage. These layers are compacted together and to an outer cation exchange membrane 27 comprising a polymer impervious to the electrolyte within the cell and to the gases formed during its operation. The membrane 27 separates each cathode 23 from the anode 22 of the adjacent bipolar unit and is compacted between the cathode 23 and anode 22 of adjacent bipolar units by reason of the resilience of the knitted spring sheet 24. The centerboard 19 of each unit is supported within or supports a dielectric plastic housing 28 and is compacted around its edges between gaskets 29 to prevent leakage of electrolyte. Similarly the membrane 27 is sealed around its edges between gaskets 29.

A comparatively low resistance electrical connection between the anode 22 and cathode 23 of each unit comprises a plurality of copper rods 30 passing freely through holes 31 spaced over the surface of the centerboard 19. Opposite ends of each rod 30 are shielded from electrolyte in the cell by anode and cathode protective covers 32 and 33 respectively which in turn are electrically connected to the anode and cathode plates 22 and 23 of the unit as described below.

The structure and operation of the cell described thus far may be conventional. For example a sodium chloride anolyte may be supplied to the anodic chamber 34 of each unit through supply ports (not shown) and sodium hydroxide catholyte may be withdrawn from the cathodic chamber 35 through discharge ports (also not shown). During operation, chlorine gas resulting from the electrolysis of the sodium chloride anolyte forms within the chamber 34 and is discharged via vents, not shown. Hydrogen gas resulting from the electrolysis collects within the chamber 35 and is similarly discharged via vents, not shown. The sodium hydroxide catholyte formed within chamber 35 as a result of the electrolysis and cation permeability of the membrane 27, as well as the chlorine and hydrogen gases, are comparatively pure and may be collected for subsequent use.

Figure 3:
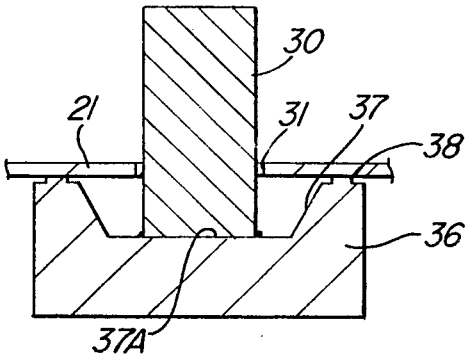
Figure 2:
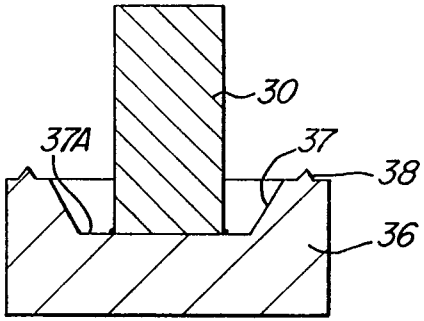

Details of the protective anode cover 32 and its method of manufacture are illustrated in FIGS. 2 and 3 wherein a thimble type button or cup 36 is provided with a recess or opening 37 having a base 37A, shaped to conform closely to the end of the copper rod 30 that projects from the anode side of the centerboard 19, and enlarging conically endwise from the base 37A. Extending coaxially around the enlarged mouth of the recess 37 is an annular endwise tapering welding projection 38.

The parts 30 and 36 are assembled as illustrated in FIG. 2 with the above mentioned end of the rod 30 seated by force against the conforming base 37A, whereupon the parts 30 and 36 are frictionally welded together by relative spinning in accordance with conventional spin welding or inertia or friction welding procedure. Thereafter the titanium button 36 is pressed against the titanium sheet 21, FIG. 3, with the rod 30 extending coaxially through one of the holes 31 at right angles to the centerboard 19 and with the welding projection 38 in contact with the titanium layer 21 entirely around the opening 31, and projection welded to the sheet 21 by conventional projection or resistance or butt welding technique.

By virtue of the annular endwise tapering welding projection 38, a positive welded seal between the titanium button 36 and titanium layer 21 is assured entirely around the rod 30. Likewise the spin or friction weld between the rod 30 and button 36 provides a positive surface-to-surface weld and low resistance electrical connection between these members that will neither deteriorate with time nor oxidize in consequence of operation of the cell.

Figure 4:
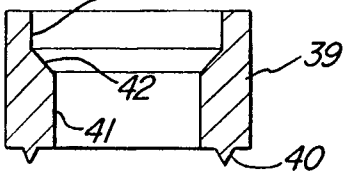

FIGS. 4 through 7 illustrate the structure and method of fabricating the protective cathode cover 33. A cylindrical steel sleeve 39, FIG. 4, is provided at one end with an annular endwise tapering welding projection 40, (similar to the projection 38) around an opening 41 through the sleeve 39 dimentioned to receive the rod 30 freely. The opening 41 enlarges conically at 42 essentially to the opposite end of the sleeve 39 to a cylindrical end portion 43. The steel sleeve 39 is arranged with its projection 40 extending coaxially around the opening 31 and in contact with the steel plate 20 of the centerboard, FIG. 5. As in FIG. 3, the parts 20 and 39 are welded together by conventional projection or stud welding technique.

Figure 5:
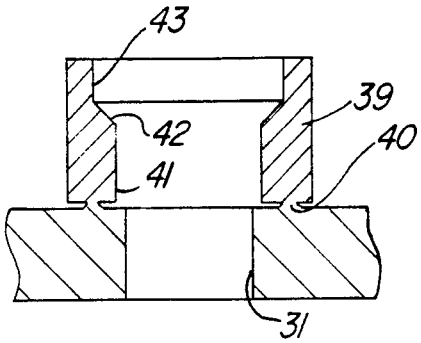

FIG. 5 shows the steel sleeve 39 welded to the steel partition plate 20 without reference to the titanium button 36 welded to the titanium sheet 21 in order to illustrate that the sequence of welding the button 36 and sleeve 39 to their respective sides of the centerboard is immaterial. The button 36 spin-welded to the end of the copper rod 30 may be the first to be welded to the centerboard 19, and the steel sleeve 39 may thereafter be welded to the plate 20 coaxially around the rod 30. Alternatively the steel sleeve 39 may be welded to the plate 20 as described above in regard to FIGS. 4 and 5 and thereafter the button 36 welded to the rod 30 may be mounted on the centerboard 19 and welded to the sheet 21 with the rod 30 extending coaxially into the hole 41 through the sleeve 39.

Figure 6:
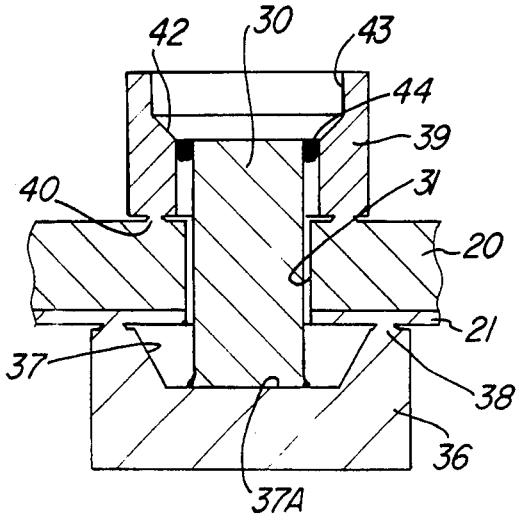

In any event, after both the button 36 and sleeve 39 are welded to their respective sides of the centerboard 19, an electrical connection between the sleeve 39 and rod 30 is completed by conventionally welding these parts together at 44 within the tapered portion 42 of the sleeve opening, FIG. 6, as for example by use of a suitable steel to copper welding alloy and conventional metal inert gas (MIG) welding technique. The radii of the holes 31 and 41 are sufficiently oversize with respect to the diameter of the rod 30 to accommodate production misalignment between the button 36 and sleeve 39. The above described spin welding and procedures at appreciable savings in time and money when compared to the manual welding required heretofore, particularly in view of the comparatively large number of rods 30 spaced on the order of six to ten inches apart over the four by eight foot area of a typical centerboard 19.

Figure 7:
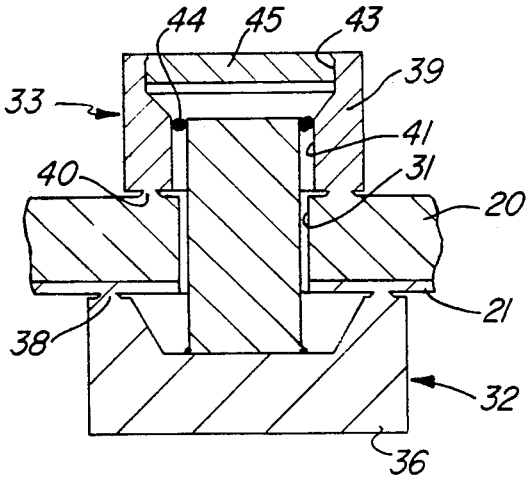

The protective cover 33 is completed as illustrated in FIG. 7 by welding a steel disc 45 within the cylindrical end opening 43 by conventional MIG welding to seal the weld 44 from contact with electrolyte within the cell. Thus the entire copper rod 30 is enclosed and sealed by the protective caps 32 and 33 welded to opposite sides of the centerboard 19 as illustrated in FIGS. 1 and 7.

Figure 8:
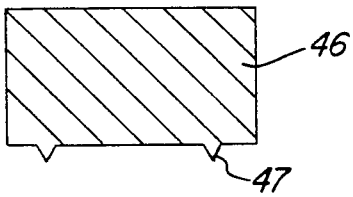
Figure 9:
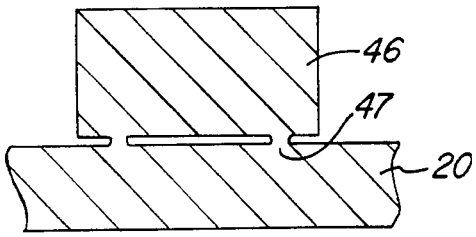

In order to provide an electrical connection between the steel plate 20 and the current collector 25 of the cathode plate assembly 23, each of a plurality of cylindrical steel spacer members or buttons 46 is provided with a coaxial annular endwise tapering welding projection 47 at one end, FIG. 8. The buttons 46 are arranged over the surface of the centerboard 19 at locations spaced radially from the various openings 31 through the centerboard, with the projections 47 confronting the steel plate 20, and are welded thereto by conventional projection or stud welding procedure, FIG. 9.

In regard to all of the endwise tapering annular welding projections 38, 40, and 47, resistance to the electrical welding charge and the consequent welding heat are concentrated at the small outer end of each tapered projection to assure positive welds to the centerboard and positive seals around the copper rods 20. Again the welding sequence is immaterial. Welding of the buttons 46 to the steel plate 20 may either preceed or follow the above described welding of either of the protective covers 32 and 33. Likewise, although spin welding of the titanium button 36 to the copper rod 30 is preferred, the arrangement of the covers 32 and 33 may be reversed. If desired, the cover 33 could comprise a steel cup-shaped button (similar in shape to the button 36) that would then be spin welded to the cathode end of the rod 30. In that event, the button 36 would be replaced by a titanium sleeve and closure cap similar to the steel sleeve 39 and disc 45.

Figure 10:
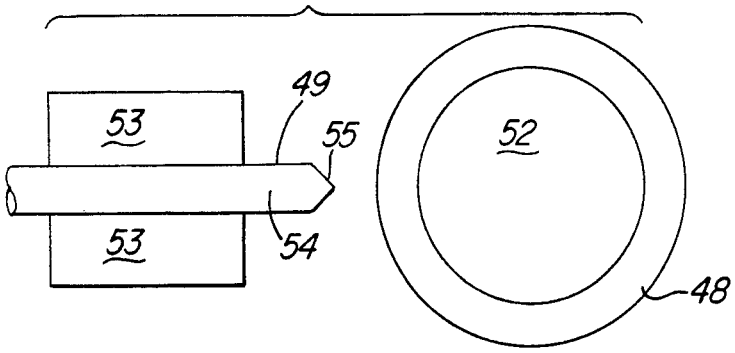
FIGS. 10 and 11 illustrate in plan view the progressive stages in welding the titanium ribs to the titanium rings.

An electrical connection between each titanium button 36 and the anode plate 22 is completed by a titanium ring 48 welded coaxially at 56 to the button 36 and by means of titanium ribs 49 extending between and welded at 55 to adjacent rings 48 in reinforcing relationships and also welded to the anode 22 at 54 in supporting relationship, FIGS. 1 and 10. Similarly each steel button 46 is electrically connected to the cathode plate 23 by means of a steel ring 50 welded at 58 to the button 46 and to steel ribs 51 extending between and welded at 61 to adjacent rings 50 in reinforcing relationship and welded at 57 to the current collector 25 in supporting relationship, FIGS. 1 and 12.

The oversize inner peripheries of the rings 48 and 50 with respect to their respective members 36 and 46 readily enable axial and radial adjustment of the locations of the outer peripheries of the rings 48 and 50 prior to being welded to the ends of their respective ribs 49 and 51. Thus in the completed structure, the anode 22 and cathode 23 of adjacent units can be precisely supported in closely spaced parallelism with each other as desired to maintain a comparatively uniform current flow per unit of area therebetween.

Figure 11:
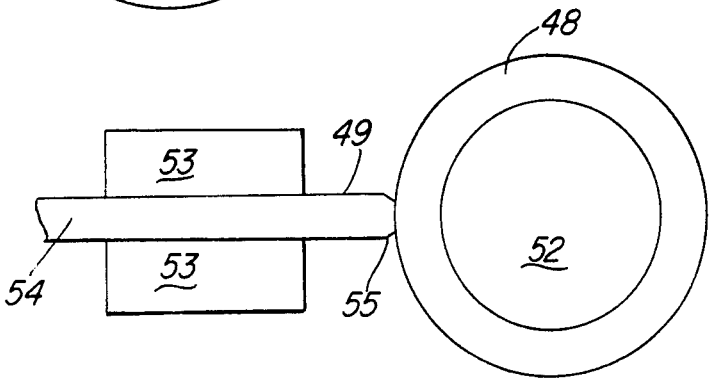

Although the operation of the cell is independent of the sequence of welding operations in its fabrications, the structure disclosed is readily fabricated by a preferred welding sequence illustrated in part in FIGS. 10 and 11. Prior to welding of the titanium rings 48 and ribs 49 together, the rings 48 may be supported on butt-welder posts 52 and the ribs 49 may be clamped between butt-welder jaws 53. The parts to be welded are adjusted axially with respect to each other until the outer edges 54 of the ribs 49 lie in a predetermined plane that will determine the plane of the anode 22 to which it is or will subsequently be welded. At the welding position, the axially extending edge 55 of each rib 49 will be in contact under pressure with the outer periphery of the ring 48. As illustrated in FIG. 10, each edge 55 is tapered endwise along its axial extent to effect a welding projection to assure a positive butt weld along the entire region of contact. The weld between the endwise tapered edge 55 and ring 58, FIG. 11, may be completed by conventional projection or butt welding technique.

The opposite end of the rib 49 may be tapered similarly to the edge shown in FIG. 10 and butt welded to an adjacent ring 48 simultaneously with the welding illustrated in FIG. 11. The welding of a rib 49 between two adjacent rings 48 may be done in the manner described below in regard to FIG. 12. In fact, depending upon the welding equipment available, a number of the ribs 49 may be welded simultaneously to their associated rings 48 with their outer edges 54 defining the desired plane for supporting the anode 22 in a predetermined position.

A disc 22A of the anode 22 may be cut out and removed from each location that will overlie one of the rings 48, and the anode plate 22 may then be welded to the coplaner upper edges 54 of the ribs 49. Like the edges 55, FIG. 10, the edges 54 may be tapered outwardly along their length to provide welding projections to facilitate and enhance welding between the ribs 49 and anode 22 by conventional projection welding or butt welding technique, FIG. 1.

Thereafter the assembled and welded together rings 48, ribs 49 and anode 22 are assembled with the buttons 36, with each ring 48 supported in adjusted position around the associated button 36 to locate the anode 22 in its predetermined desired plane. The rings 48 and buttons 36 may then be welded together by conventional tungsten inert gas (TIG) welding through the openings provided by removal of the discs 22A, whereupon the cutout discs 22A are replaced and welded at 22B to restore the surface of anode 22. If desired, each disc 22A may then be welded to the outer edge 54 of the adjacent rib 49.

The steel rings 50, buttons 46, ribs 51, and anode current collector 25 may be adjustably assembled and welded together in the manner described above in regard to their counterparts 48, 36, 49, and 22. To facilitate welding of the rings 50 to the buttons 46 at 58 subsequent to welding of the collector 25 to the tapered outer edges 57 of the ribs 51, a disc 25A of the current collector 25 may first be cut out and subsequently replaced and welded at 25B to the plate 25 in the manner of the cut-out 22A.

Figure 12:
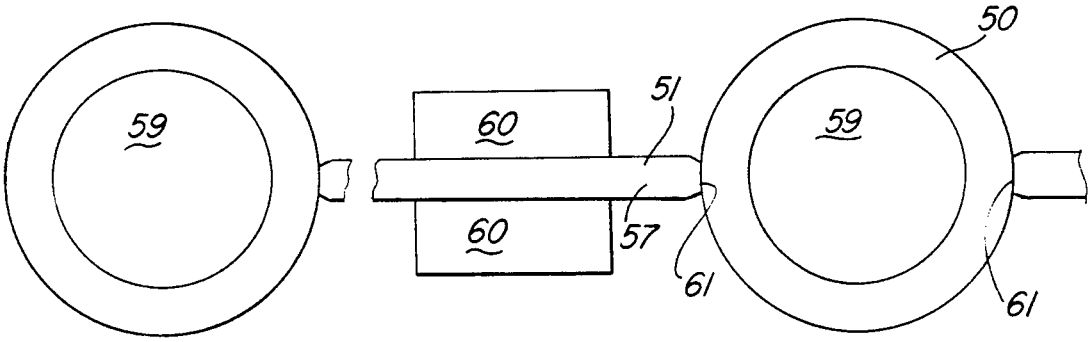
FIG. 12 is a view similar to FIG. 11 showing a steel rib welded to its steel ring.

Similarly to the welding of the titanium ribs 49 and rings 48, adjacent rings 50 may be supported on butt welder posts 59, FIG. 12. The ribs 51 clamped between butt welder jaws 60 may be forced into adjusted contact between the adjacent rings 50 with the tapered outer edges 57 defining a plane supporting surface for the collector 25 to which they are then butt or projection welded. The opposite ends of the steel ribs 51 may also be tapered endwise at 61 to facilitate the projection or butt welding to the rings 50, FIG. 12. The welding projections provided by the tapered edges 54, 55, 57 and 61 perform in the manner of the annular tapered welding projections 38 and 47 to enhance and facilitate the projection welds.

After the rings 50 are welded to the buttons 46, with the ribs 51 and collector plate 25 in the desired adjusted position, the cathode layers 24 and 26 and membrane 27 are layered on the collector 25 and compacted into contact with each other in accordance with conventional practice to complete the bipolar unit. The next adjacent bipolar units are similarly constructed.

Although the titanium buttons 36 and steel spacer buttons 46 are connected by their respective ribs 49 and 51 to the anode plate 22 and cathode plate 25 in the present instance, if desired, the steel protector 33 could be adjustably connected to the plate 25 by adjustable steel rings and ribs comparable to the titanium rings 48 and ribs 49. In such a situation the steel buttons 46 and the rings 48 and ribs 49 will not be used. Instead titanium spacer buttons comparable to the buttons 46, and titanium rings and ribs comparable to the rings 50 and ribs 51, will connect the titanium plate 21 and anode 22 similarly to the structure described in regard to the steel buttons 46, rings 50, and ribs 51 connecting the plates 20 and 25.

I claim:

1. A bipolar electrolytic cell comprising a centerboard having opposite anode and cathode surfaces confronting and spaced from an anode and a cathode respectively, an electrically conductive rod extending transversely through said centerboard, first and second protective cover means electrically connected with said rod and cooperable with said centerboard for completely shielding said rod and its electrical connections from fluid in said cell, said first cover means comprising an electrically conductive cup having its opening overlying one end of said rod and having an annular rim portion around the mouth of said opening welded to one of said surfaces of said centerboard entirely around said rod, said rod and the interior of said cup having coextensive shaped surface portions joined by a direct surface-to-surface weld therebetween throughout their coextensive surfaces.

2. A cell according to claim 1 wherein said one end of said rod extends into the opening of said cup to the base of said opening, said shaped surface portions comprise said one end and said base conforming closely to each other and frictionally welded together.

3. A cell according to claim 2 wherein said cup and said one surface of said centerboard comprise titanium.

4. A cell according to claim 1, wherein said rim portion welded to said one surface comprises an annular endwise tapering welding projection butt welded to said one surface, and said welded together shaped portions comprise a base portion of said opening shaped to conform closely to said one end of said rod and frictionally welded thereto.

5. A cell according to claim 4, means enabling radial adjustment of said rod with respect to said centerboard comprising a hole extending transversely through said centerboard, said hole containing said rod and being oversize with respect to said rod to enable said radial adjustment sufficient to compensate for production tolerances in the locations of said first and second protective cover means.

6. A cell according to claim 1 wherein said anode and cathode comprise parallel anode and cathode plates respectively of a bipolar unit comprising one of a plurality of such units in series, wherein the anode and cathode plates of adjacent bipolar units are in closely spaced parallelism with each other, and wherein said protective cover means are electrically conductive and electrically connected respectively with opposite surfaces of said centerboard, an electrically conductive ring extending around one of said cover means with its principal axis transverse to one of said plates, and an electrically conductive plate supporting rib welded to said one plate, said ring and rib being located at selected axial positions with respect to each other and to said one cover means for locating said one plate at a selected position with respect to said one cover means whereat said one plate is maintained in said closely spaced parallelism with the corresponding other plate of the adjacent bipolar unit, said ring being welded to said rib and to said one cover means at said positions.

7. A cell according to claim 6 wherein the assembly of said one cover means, ring, and rib comprise one of a plurality of such assemblies spaced over the surface of said centerboard, said one cover means of each assembly having an annular welding projection around the axis of the associated ring and confronting said one surface of the centerboard and butt welded thereto, the associated rib extending from the outer periphery of the associated ring to the outer periphery of the ring of an adjacent assembly and having axially extending welding projections at its opposite ends welded to said outer peripheries, and each rib having an outer edge confronting said one plate and also having a welding projection extending along said outer edge, the latter welding projection of each rib in said assemblies lying in a predetermined plane and being welded to said one plate to support the latter in a predetermined plane.

8. A cell according to claim 7, the ring of each assembly comprising an annulus having its inner periphery spaced radially from the one cover means of that assembly to accommodate production tolerances in the welding connections of said ring with the associated ribs and said one cover means.

9. A cell according to claim 1, said anode and cathode comprising parallel anode and cathode plates respectively of a bipolar unit comprising one of a plurality of such units in series, wherein the anode and cathode plates of adjacent bipolar units are in closely spaced parallelism with each other, and said rod comprises with its associated cup one of a plurality of similar assemblies spaced over the area of the centerboard, said one surface of the centerboard confronts the anode plate, said rim portion of said cup comprising a welding projection butt welded to said anode surface, an electrically conductive ring in each assembly around the associated cup with the axis of the ring transverse to the centerboard, an electrically conductive anode supporting rib associated with each ring and extending to another associated ring of an adjacent assembly, each rib having an outer edge and a welding projection extending along said edge and welded to said anode plate, each rib and its associated rings being adjusted axially to selected positions with respect to each other and to said cup for supporting said anode plate in a predetermined plane in closely spaced parallelism with the cathode plate of the adjacent bipolar unit, each rib having an axially extending welding projection at each of its opposite ends butt welded at said selected positions to the outer peripheries of the associated rings respectively, the inner periphery of each ring being spaced radially from the associated cup to accommodate production tolerances in the welding of said ribs to said rings and being welded to the associated cup.

10. A bipolar electrolytic cell having parallel anode and cathode plates spaced by a centerboard having opposite anode and cathode surfaces confronting and spaced from said anode and cathode plates respectively, means for electrically connecting said centerboard with one of said plates and for supporting said one plate at a predetermined position comprising an electrically conductive member secured to and extending from the surface of said centerboard that confronts said one plate, an electrically conductive ring extending around said member with its principal axis transverse to the centerboard, an electrically conductive plate supporting rib welded to said one plate and to said ring, said ring and rib welded thereto being axially adjusted to a selected position with respect to said member for supporting said one plate at said predetermined position, and said ring being welded to said member to secure said ring and rib at said selected position.

11. A cell according to claim 10 wherein the assembly of said member, ring, and rib comprises one of a plurality of such assemblies spaced over the surface of the centerboard, each member having an annular welding projection around the axis of the associated ring and butt welded to said one surface of the centerboard, each rib extending from the outer periphery of the associated ring to the outer periphery of the ring of an adjacent assembly and having axially extending welding projections at its opposite ends butt welded to said outer peripheries, each rib having an outer edge confronting said one plate and also having a welding projection extending along said outer edge, the welding projections of said ribs defining a predetermined plane and being butt welded to said one plate to support the latter in a predetermined plane.

12. A cell according to claim 11, each ring comprising an annulus having its inner periphery spaced radially from the associated member to accommodate production tolerances in the welding connections of said rings with said ribs and members.

13. A method for effecting electrical connection for a bipolar electrolytic cell having parallel anode and cathode plates spaced by a centerboard, a plurality of holes extending transversely through said centerboard at locations spaced over its surface area, and a low resistance electrically conductive rod located in each hole and having an axis transverse to the centerboard, said method comprising the steps of A. providing for each rod an electrically conductive cup having its opening dimensioned to receive an end of the rod freely therein and having a rim around the mouth of the opening dimensioned to seat against the surface of the centerboard around the hole for the rod, B. shaping the base of the opening to conform closely to the end of the rod for which it is provided, C. forcing the latter end of the rod to a seated position against the shaped base of said opening, and D. spinning the rod and cup relative to each other about the axis of the rod to frictionally weld the rod and cup together at the shaped base.

14. A method according to claim 13 and comprising the additional steps of

E. inserting each rod (with the cup welded thereto) into the associated centerboard hole with said rim of the cup confronting a surface of the centerboard entirely around the hole, and F. welding the rim to said centerboard surface to effect a seal between the cup and centerboard entirely around the rod.

15. A method according the claim 14 and comprising prior to step F the additional step of G. forming the rim to provide an annular endwise tapering welding projection, and wherein step F comprises butt welding said welding projection to said centerboard surface.

16. A method according to claim 14 and also for facilitating the support of one of the anode and cathode plates in a predetermined position, the additional steps of H. providing a ring for each cup having an inner circumference dimensioned to extend freely around the outer periphery of the cup in radially spaced relationship to enable relative axial and radial adjustment of said cup and ring with respect to each other, I. providing ribs for supporting said one plate, J. dimensioning each rib (a) to extend endwise between the outer circumferences of adjacent rings, and (b) to provide an outer edge adapted in cooperation with the outer edges of the other ribs to define a predetermined plane, K. welding the inner and outer peripheries of the rings to the associated cup and to the ends of the ribs respectively in preselected adjusted positions with respect to each other and with the outer edges of said ribs in said predetermined plane.

17. A method according to claim 16 and comprising the additional step of L. forming each rim to provide an annular endwise tapering welding projection, and M. forming the opposite ends of each rib to provide edgewise tapering welding projection, and wherein the welding in step F comprises butt welding said welding projections of said rims to said centerboard and the welding in step K comprises butt welding the welding projections of said ribs to the outer peripheries of the adjacent rings.

18. A method for facilitating the fabrication of an electrical connection for a bipolar electrolytic cell having parallel anode and cathode plates spaced by a centerboard, said method comprising the steps of A. providing a plurality of electrically conductive members adapted to be secured to one surface of the centerboard at locations spaced over the area of the centerboard, B. providing a separate ring for each member having an inner circumference dimensioned to extend freely around the outer periphery of the member in radially spaced relationship to enable relative axial and radial adjustment of said ring and member to predetermined adjusted positions with respect to each other, C. providing ribs for supporting the one of said plates that confronts said one surface of said centerboard, D. dimensioning each rib (a) to extend endwise between the outer circumferences of adjacent rings, and (b) to provide an outer edge adapted in cooperation with the outer edges of the other ribs to define a predetermined plane, E. securing said members to said one surface and welding the inner and outer peripheries of the rings to the associated members and to the ends of the ribs respectively in preselected adjusted positions with respect to each other and with the outer edges of said ribs in said predetermined plane.

19. A method according to claim 18 and comprising the additional steps of F. forming each member at one end thereof with an annular endwise tapering welding projection, and G. forming the opposite ends of each rib to provide endwise tapering welding projections, and wherein step E comprises butt welding said welding projections of said members to said one surface of said centerboard and butt welding the welding projections of said ribs to the outer peripheries of the adjacent rings.

20. A method according to claim 18 wherein the welding in step E also comprises welding said one plate to said outer edges of said ribs in said plane and is completed by F. supporting the rings and ribs in adjusted positions with respect to each other with the ribs extending between and engaging the outer peripheries of adjacent rings and with the outer edges of said ribs in said predetermined plane, G. welding the ends of said ribs and the outer edges thereof respectively to the outer peripheries of said rings and to said one plate in said predetermined adjusted positions, and H. thereafter welding the inner peripheries of said rings to said associated members in said positions of axial adjustment.

* * * * *

UNITED STATES PATENT AND TRADEMARK OFFICE

CERTIFICATE OF CORRECTION

PATENT NO. : 4,713,162

DATED : December 15, 1987

INVENTOR(S) : John R. Pimlott

It is certified that error appears in the above-identified patent and that said Letters Patent is hereby corrected as shown below:

Col. 7, line 52, insert -- projection welding may be carried out by high speed automated -- between "and" and "procedures".

Col. 8, line 18, "and" should read -- or --.

Col. 12, line 28, insert -- an -- between "effecting" and "electrical".

Col. 14, line 38, delete "predetermined".

Signed and Sealed this

Nineteenth Day of July, 1988

*Attest:*

DONALD J. QUIGG

*Attesting Officer*

*Commissioner of Patents and Trademarks*